US006866694B2

(12) United States Patent
Moreau et al.

(10) Patent No.: US 6,866,694 B2
(45) Date of Patent: Mar. 15, 2005

(54) AIR FILTER UNIT FOR A VEHICLE WITH AN INTERNAL-COMBUSTION ENGINE

(75) Inventors: Fabien Moreau, Orbey (FR); Eric Gross, Colmar (FR)

(73) Assignee: Mark IV Systemes Moteurs (Societe Anonyme), Coubevoie (FR)

( * ) Notice: Subject to any disclaimer, the term of this patent is extended or adjusted under 35 U.S.C. 154(b) by 25 days.

(21) Appl. No.: 10/198,485

(22) Filed: Jul. 18, 2002

(65) Prior Publication Data

US 2003/0051453 A1 Mar. 20, 2003

(30) Foreign Application Priority Data

Jul. 19, 2001 (FR) ..... 01 09687

(51) Int. Cl.[7] ..... B01D 46/00

(52) U.S. Cl. ..... 55/385.3; 55/497; 55/502; 55/493; 55/503; 123/198 E; 180/68.1; 180/69.2

(58) Field of Search ..... 55/385.3, 497, 55/502, 493, 503; 123/198 E; 180/68.1, 69.2

(56) References Cited

U.S. PATENT DOCUMENTS

| | | | | |
|---|---|---|---|---|
| 4,817,967 A | * | 4/1989 | Belter | 123/198 E |
| 4,897,097 A | | 1/1990 | Yamamura | |
| 4,929,263 A | * | 5/1990 | Kasugai | 55/502 |
| 5,222,745 A | * | 6/1993 | Akbar et al. | 123/198 E |
| 5,569,311 A | | 10/1996 | Oda et al. | |
| 5,605,554 A | * | 2/1997 | Kennedy | 55/385.3 |
| 5,640,937 A | * | 6/1997 | Slopsema | 123/198 E |
| 5,730,768 A | * | 3/1998 | Kaminaga et al. | 55/385.3 |
| 6,058,903 A | * | 5/2000 | Downham | 123/198 E |
| 6,067,953 A | * | 5/2000 | Bloomer | 123/198 E |
| 6,143,049 A | | 11/2000 | Gieseke et al. | |
| 6,263,850 B1 | * | 7/2001 | Winmill et al. | 123/198 E |
| 6,355,077 B1 | * | 3/2002 | Chittenden et al. | 55/385.3 |
| 6,355,095 B1 | * | 3/2002 | Kuo-Long | 55/385.3 |

FOREIGN PATENT DOCUMENTS

| | | |
|---|---|---|
| DE | 195 09 825 | 9/1995 |
| JP | 07310611 | 11/1995 |
| JP | 11013561 | 1/1999 |
| JP | 11082193 | 3/1999 |
| JP | 2000008976 | 1/2000 |

* cited by examiner

*Primary Examiner*—Minh-Chau T. Pham
(74) *Attorney, Agent, or Firm*—Chapman and Cutler LLP

(57) ABSTRACT

The present invention concerns an air filter unit for a vehicle with an internal-combustion engine. Air filter unit for a vehicle with an internal-combustion engine, having an air filter and a hollow case containing and holding the air filter in position, characterized in that said case is composed, as the one hand, of a lower part forming an open receptacle for said filter and made up of at least two elementary parts assembled at complementary formations of their edges placed in contact and, on the other hand, of an upper part forming a cover and closing the upper part of the lower part, said upper and lower parts being assembled, with insertion of a seal or a packing, at the lower peripheral edge of said upper part and at the peripheral edge of the opening of the lower part.

21 Claims, 4 Drawing Sheets

AIR FILTER UNIT FOR A VEHICLE WITH AN INTERNAL-COMBUSTION ENGINE

The present invention relates to the field of equipment for vehicles with an internal-combustion engine and its subject is an air filter unit for such a vehicle.

BACKGROUND OF THE INVENTION

It is well known that air filter units are made up of a hollow case containing the air filter and equipped with an inlet orifice for external air and an output orifice for filtered air.

Cases are often made of thermoplastic materials generally with complex shapes that are difficult to produce by injection moulding.

In addition, despite the case having a detachable part, removing the filter is still often tiresome, due to the opening being too small, the orientation of the opening being in a direction which has too little clear space or the need to make several movements of said filter in said case before being able to remove it.

Moreover, there is a need to produce air filter units that are easier to assemble and disassemble, more rigid and more resistant to stresses and impacts, that can be produced in different configurations according to the planned size and that have a better seal.

SUMMARY OF THE INVENTION

The object of the present invention is particularly to overcome at least some of the above-mentioned drawbacks and/or to respond to at least some of the needs expressed above.

To this end, the object of the present invention is an air filter unit for a vehicle with an internal-combustion engine, comprising an air filter and a hollow case containing and holding the latter in position, characterised in that said case is composed, on one hand, of a lower part forming an open receptacle for said filter and made up of at least two elementary parts assembled at complementary formations at their edges put in contact and, on the other hand, of an upper part forming a cover and closing the upper opening of the lower part, said upper and lower parts being assembled, with insertion of a seal or packing, at the lower peripheral edge of said upper part and at the peripheral edge of the opening of the lower part.

BRIEF DESCRIPTION OF THE DRAWINGS

The invention will be better understood through the description below, which refers to a preferred embodiment, given by way of non-restrictive example, and explained with reference to the accompanying diagrammatic drawings, in which.

DETAILED DESCRIPTION OF THE INVENTION

Figure 1:
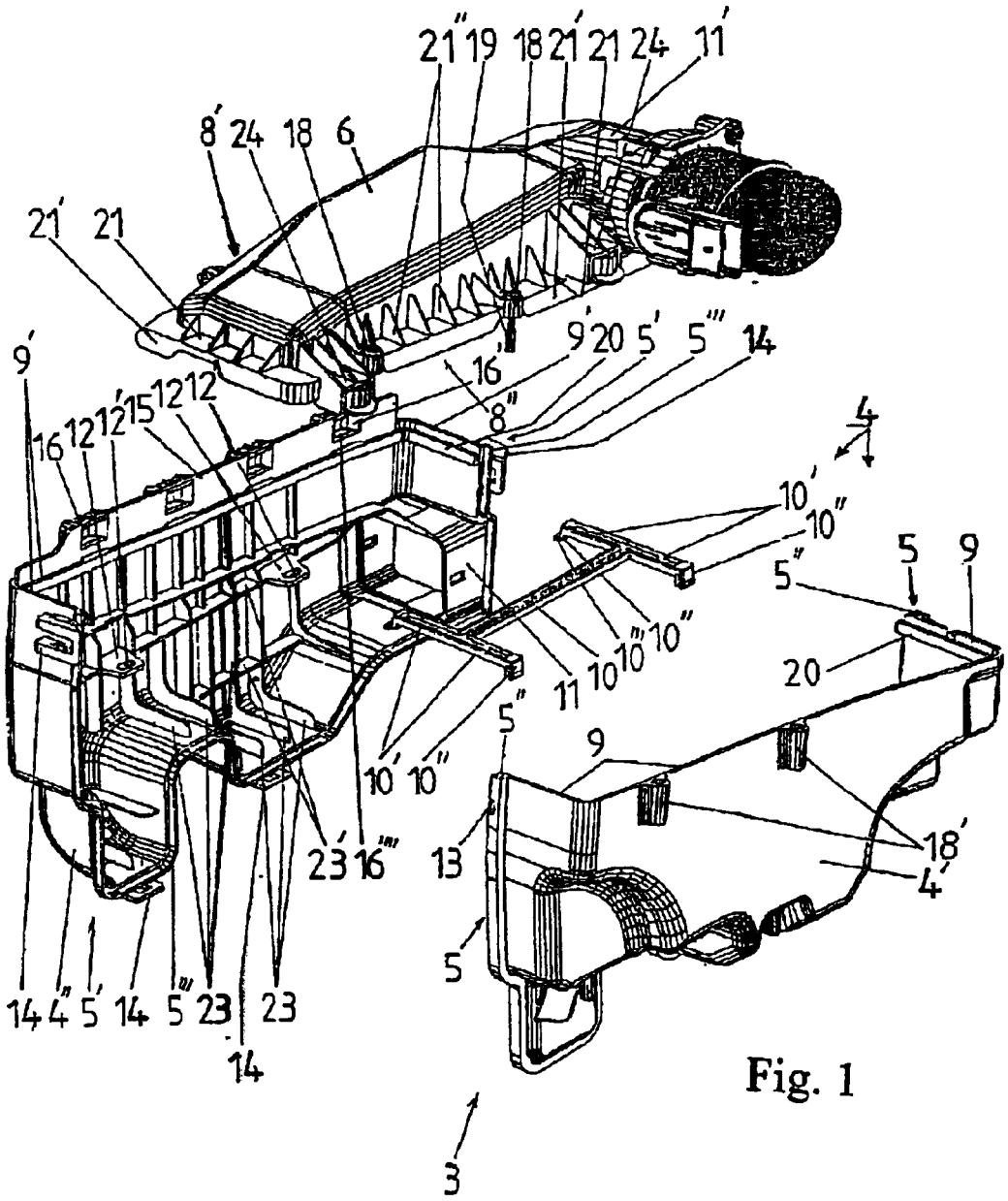
FIGS. 1 and 2 are views exploded in two different directions of a case of an air filter unit according to the invention.

The invention relates to an air filter unit 1 for a vehicle with an internal-combustion engine, comprising an air filter 2 and a hollow case 3 containing and holding the latter in position.

As shown in FIGS. 1 to 6 of the accompanying drawings, said case 3 is composed, on one hand, of a lower part 4 forming an open receptacle for said filter 2 and made up of at least two elementary parts 4', 4" assembled at complementary formations of their edges 5, 5' in contact and, on the other hand, of an upper part 6 forming a cover and closing the opening 7 of the lower part 4, said upper part 6 and lower part 4 being assembled, with insertion of a seal or packing 22 at the lower peripheral edge 8 of said upper part 6 and at the peripheral edge 9, 9' of the opening 7 of the lower part 4.

The lower receptacle 4 may be made up of two, three or four assembled components.

Nevertheless, in accordance with a preferred embodiment of the invention, the lower part 4 is composed of two half-casings 4' and 4" cooperating to form said lower part 4 and assembled by mutual peripheral nesting, in a joint plane, of formations with substantially complementary profiles of their respective edges 5, 5' in contact, a cross bracing piece 10 rigidly connecting said two half-casings 4' and 4".

As is shown in the accompanying drawings, the filter 2 is arranged immediately below the cover 6 and, consequently, is easily accessible.

To facilitate its removal, it is advantageously provided that the opening 7 of the lower part 4 and the portion 4'" of this part 4 adjoining said opening 7 and receiving the filter 2, have a section corresponding substantially to that of said filter 2 (with dimensions at least slightly greater than the latter).

Preferably, and as illustrated more particularly in FIGS. 1, 3 and 6, the filter 2, and the upper portion 4'" of the lower receptacle 4 receiving said filter 2, have a structure in substantially the general form of a right-angled parallelepiped and the cross bracing piece 10 has the form of an H, making a double connection between the two half-casings 4' and 4", one of the half-casings incorporating an external air inlet sleeve 11 opening below the filter 2 and the upper part 6 forming a cover incorporating in one piece, a filtered air outlet sleeve 11' opening above said filter 2.

The sleeve 11 can be made wholly or partly in one piece with the corresponding half-casing 4' or 4" and/or be wholly or partly made up of a detachable piece, for example fixed by clipping on.

In a variation, said sleeve 11 may also be partly formed on the two half-casings 4' and 4" and be assembled during assembly of the lower receptacle 4.

Figure 3:
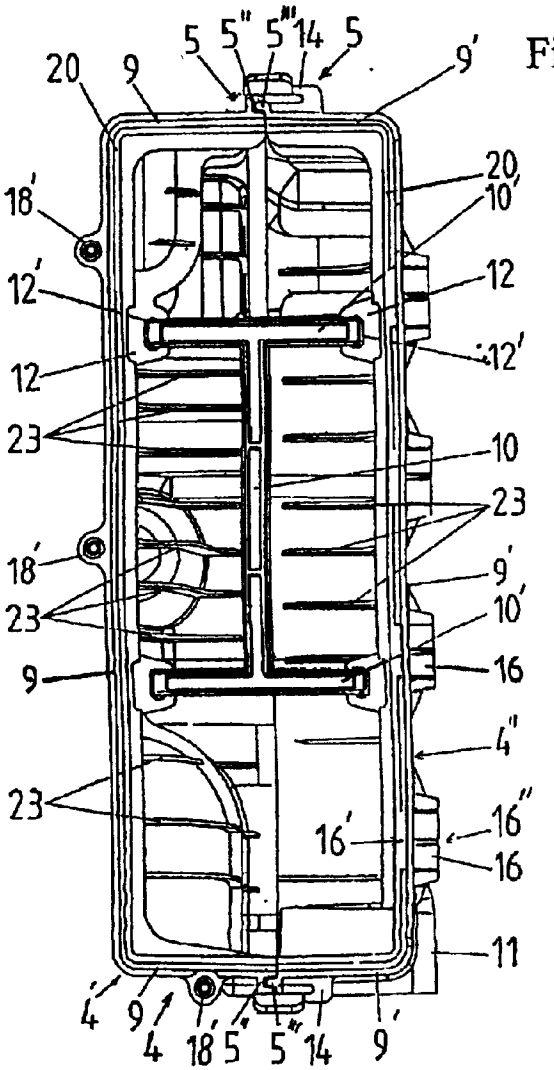
FIG. 3 is a view from above of the lower part forming a receptacle of the case illustrated in FIGS. 1 and 2.

As is shown in FIGS. 1 and 3, the cross bracing piece 10 can advantageously be connected to the half-casings 4' and 4" by fitting bent end portions 10" of branches 10' of the H in through orifices 12, made in tongues 12 formed on the internal faces of the longitudinal walls of the two half-casings 4' and 4".

The bent end portions 10" of two of the branches 10' can be extended by additional segments 10'" for locking of H-shaped piece 10 when assembled (extensions at right angles to said portions 10").

In accordance with a characteristic of the invention, the seal and mechanical assembly between the two half-casings are achieved by nesting of complementary formations, forming a baffle structure along the line of assembly.

To this end, one 4' of the half-casings 4', 4" comprises a U-section edge formation 5 forming a peripheral groove 5" and the other half-casing 4" comprises a flange-shaped edge formation 5' forming a peripheral rib 5'", this groove and this rib being formed on the external sides of the walls of the corresponding half-casings 4', 4".

For easy assembly while guaranteeing a good seal, the groove 5" and the rib 5'" have complementary truncated forms in cross section (FIGS. 1, 2, 3 and 6).

According to a first variation of the invention, ensuring rapid construction and easy disassembly, without damage to the receptacle 4 of the case 3, the assembly of the two half-casings 4' and 4" is locked by mutual elastic interlocking of the complementary means of several pairs of cooperating means 13, 14, each formed on one of said half-casings 4', 4" at their edges 5 and 5' in contact, one means 13 having the form of a projecting notch formed on the external face of the formation 5" of the edge 5 of the half-casing 4' and the other means 14 having the form of a U-shaped elastic lip, formed on the external face of the half-casing 4", extending over the edge 5' thereof to engage under tension with said notch 13 when the two half-casings 4' and 4" are assembled.

The interlocking of the lip 14 on the notch 13 only occurs when the formations 5' and 5'" are force fitted in one another, resulting in assembly without play of the two half-casings 4' and 4".

Preferably, a pair of means 13, 14 will be provided at each end of the edges 5, 5' of the half-casings, close to the edge of the opening 7 of the receptacle 4, and at least two pairs of means 13, 14 on the portions of said edges 5, 5' situated at the bottom of said receptacle 4.

According to a second variation of the invention, not illustrated in the accompanying drawings, the assembly of the two half-casings 4' and 4" is made non-detachable by establishing a rigid continuous bond between them, for example by lamination or vibration welding at the formations of the edges 5 and 5' in contact.

To perfect or guarantee the seal at the jointing plane of the two half-casings 4' and 4", in particular when they are assembled by latching, a joint may be housed in the groove 5", for example in the form of a joint set in silicone, and, if need be, compressed by the jointing of the rib 5'" in this groove in view of the assembly of the two half-casings 4' and 4" (not illustrated).

As for the two half-casings 4' and 4", the invention may advantageously also provide the opportunity of rapid fitting/removal of the cover 6 in relation to the receptacle 4, while guaranteeing good mechanical strength, a rigid connection and a good seal when these two constituent parts of the case 3 are assembled.

To this end, and in accordance with an advantageous embodiment of the invention, the means of assembling the cover 6 with the receptacle 4 consist of a portion of wall 15 extending the longitudinal wall of one of the two half-casings 4', 4" beyond its upper edge 9, 9' and provided with at least two, preferably four, passages 16 forming eyelets for the reception of two, preferably four, connecting lugs 17 extending or formed on a longitudinal part 8' of the lower peripheral edge 8 of the cover 6, the part of longitudinal edge 8" opposite the latter and the upper edge 9', 9 of the longitudinal wall of the other half-casing 4", 4' being equipped with two, preferably two pairs of, sites 18, 18" cooperating for fitting of a means of connection 19 to lock the cover 6/receptacle 4 assembly (FIGS. 1, 2, 5 and 6).

Preferably, the eyelet-shaped passages 16 are formed of portions of sleeves of substantially rectangular section flaring towards their respective inlet openings 16' and the lugs 17 have a substantially rectangular cross section tapering towards their free ends.

Such arrangements provide an aid to the introduction of lugs 17 into eyelets 16, and a strong mechanical connection between the cover 6 and the receptacle 4.

Figure 2:
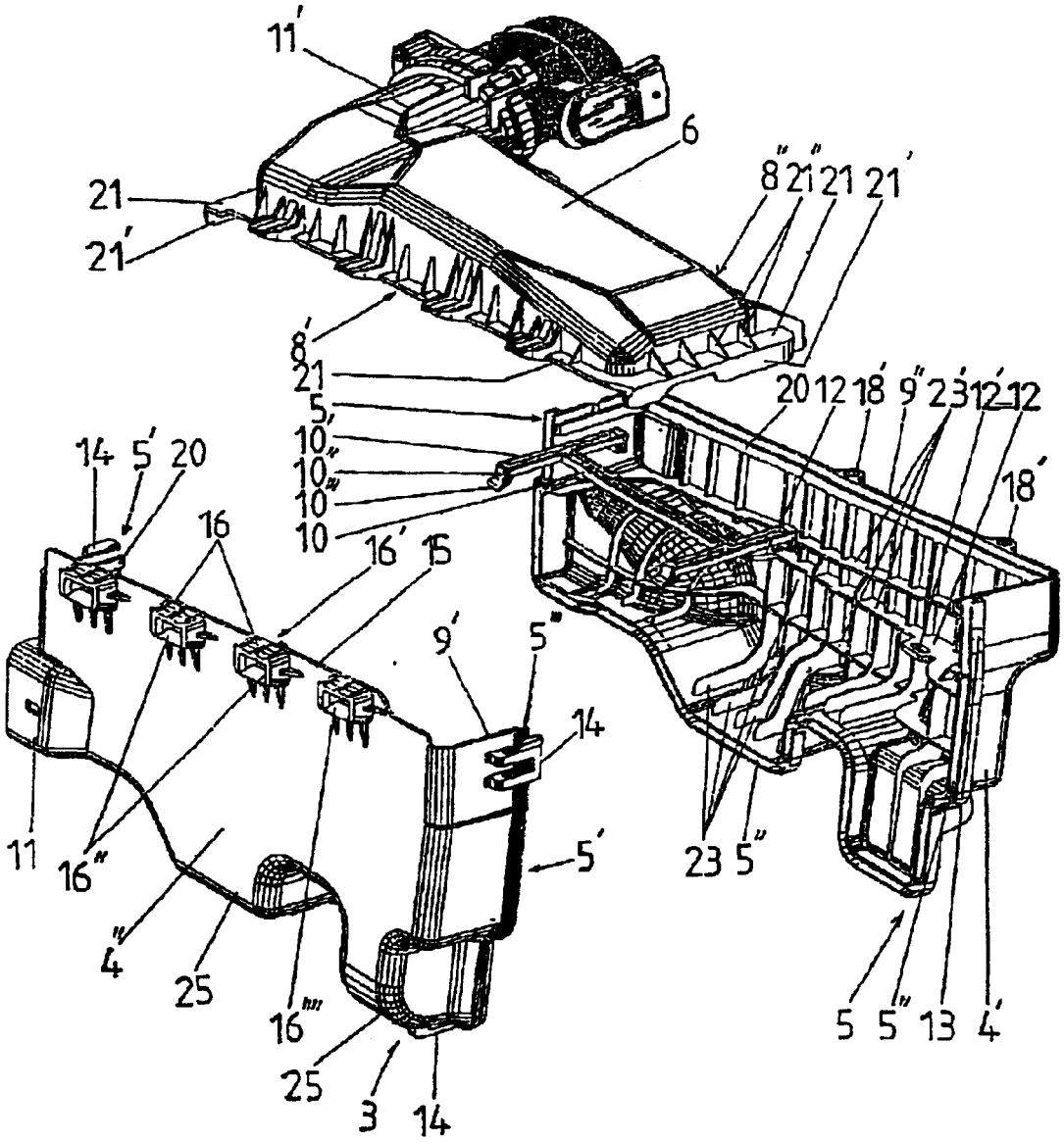
Figure 4:
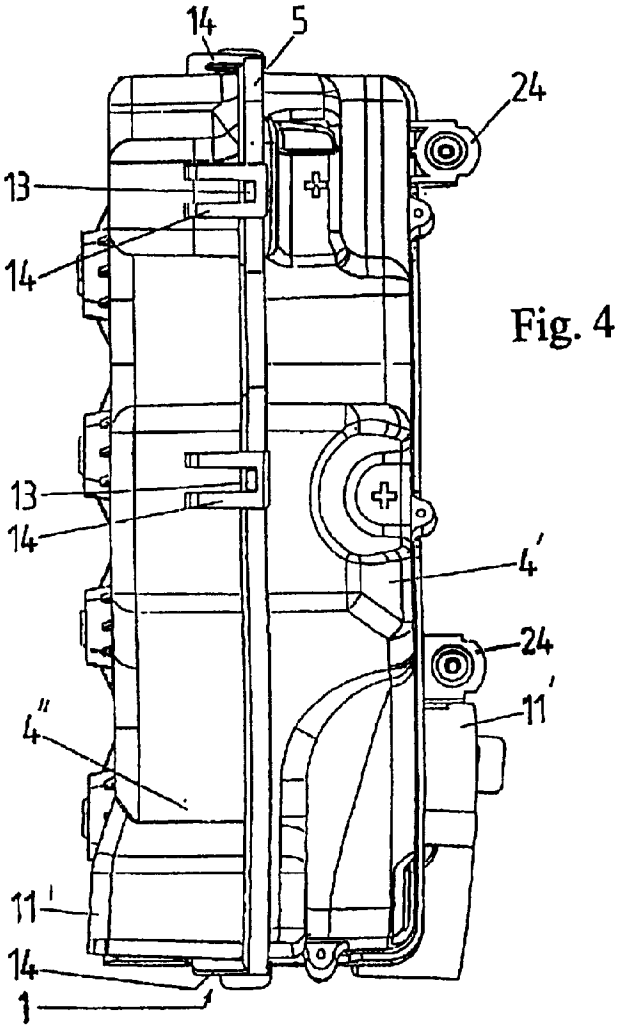
FIGS. 4 and 5 are views respectively from below and in side elevation (slightly in perspective) of an air filter unit according to the invention.
Figure 6:
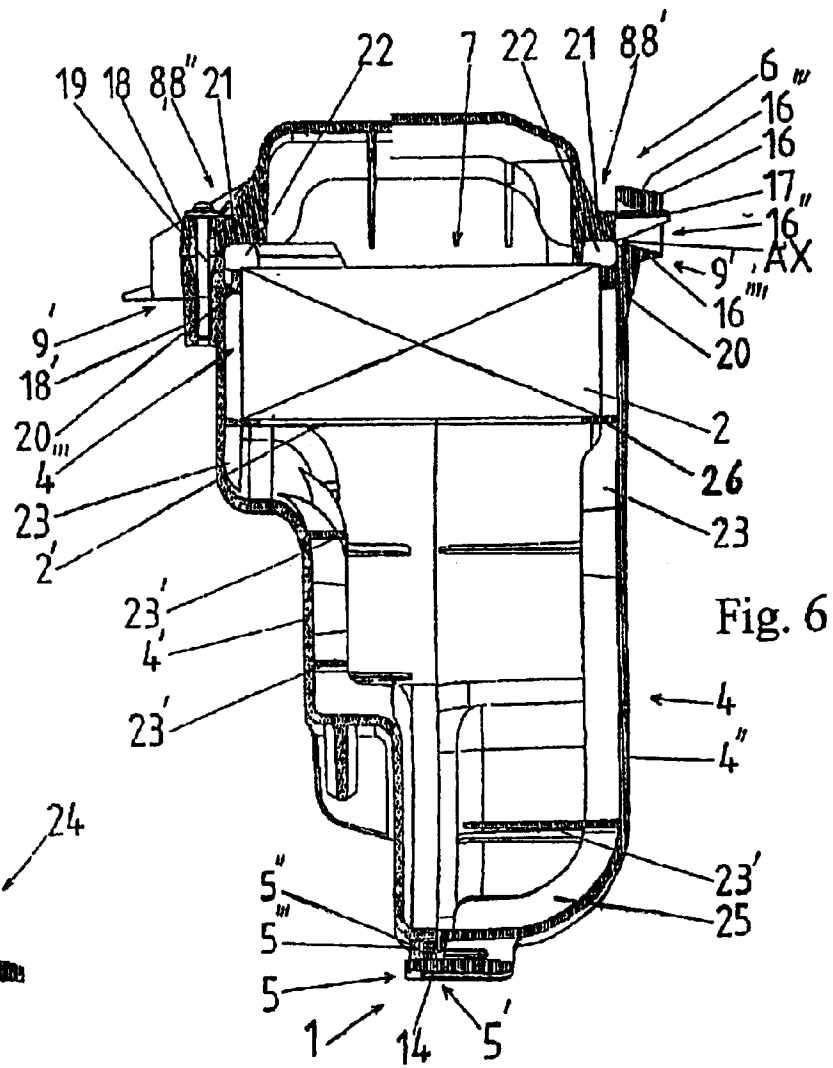
FIG. 6 is a view in side elevation and in section on two non-axial planes of the air filter unit illustrated in FIGS. 4 and 5, and, FIG. 7 is a detailed view in section of a swivel joint mounting site for fixing the unit according to the invention.

In accordance with an advantageous characteristic of the invention, illustrated particularly in FIGS. 1, 2 and 6 of the drawings, or at least emerging therefrom, the lower faces of the connecting lugs 17 and the lower internal walls 16'" of the eyelets 16 in the form of sleeves are in contact at the contact areas formed by portions of aligned rows or strips providing together a pivot axis AX, after introduction of said lugs 17 into said eyelets 16 for folding down the cover 6 onto the receptacle 4 until a forced peripheral contact is obtained therebetween with compression of the seal 22, the assembly being maintained simultaneously by connection means 19 fitted in suitable cooperating sites 18 and 18' and by support of the upper surfaces of the connecting lugs 17 against the upper internal walls 16"" of said eyelets 16 in the form of sleeves.

To facilitate still further the first phase of connection of the cover 6 to the receptacle 4, it is possible for the eyelets 16 in the form of sleeves to have inlet 16' and outlet 16" openings flaring in opposite directions, so as to form crossing passages tilted in relation to the plane receiving the cover 6 when assembled with the receptacle 4.

Thus, after introduction of the lugs 17 into the eyelets 16 in a tilted oblique position, a sealed contact is achieved between the edges opposite the receptacle 4 and the cover 6 simply by folding down said cover 4 and pressing on its side opposite the one with said lugs 17, resulting in continuous peripheral compression of the seal 22.

As shown in FIGS. 1, 2, 3 and 6 of the accompanying drawings, the two half-casings 4', 4" comprise at their edges 9, 9" which together define the peripheral edge of the opening 7 of the receptacle 4, a circumferential formation 20 forming an internal rim and the cover 6 comprises a portion of wall 21 in the form of a lateral peripheral band, extending radially towards the outside from its lower peripheral edge 8 and overlapping the above-mentioned internal rim 20 when cover 6/receptacle 4 are assembled. The filter 2 has at its upper peripheral edge the packing 22, formed in one piece with it and squeezed between the internal rim 20 and the lateral peripheral band 21 during assembly of cover 6/receptacle 4, thus ensuring a perfect seal at the assembly interface between said cover 6 and said receptacle 4.

According to another characteristic of the invention, illustrated in FIG. 6 of the accompanying drawings, the filter 2 is provided on its lower face, directed towards the bottom of the receptacle 4, with a pre-filter 2' and said receptacle 4 is equipped with an internal peripheral projection, for example in the form of a flange, extending immediately below the pre-filter 2' when said filter 2 is fitted in the case 3.

Said pre-filter may, for example, be in the form of a foam barrier, a grating, a woven, non-woven or similar structure.

The peripheral projection 26 will channel the flow of air going back up into casing 3 towards the pre-filter 2' and the filter 2, preventing the passage of air coming from the outside between the side walls of the case 3 and the filter 2.

Advantageously, said projection 26 will lead to a slight peripheral compression of the pre-filter 2', to avoid the passage of air between these elements at their opposite surfaces.

Figure 5:
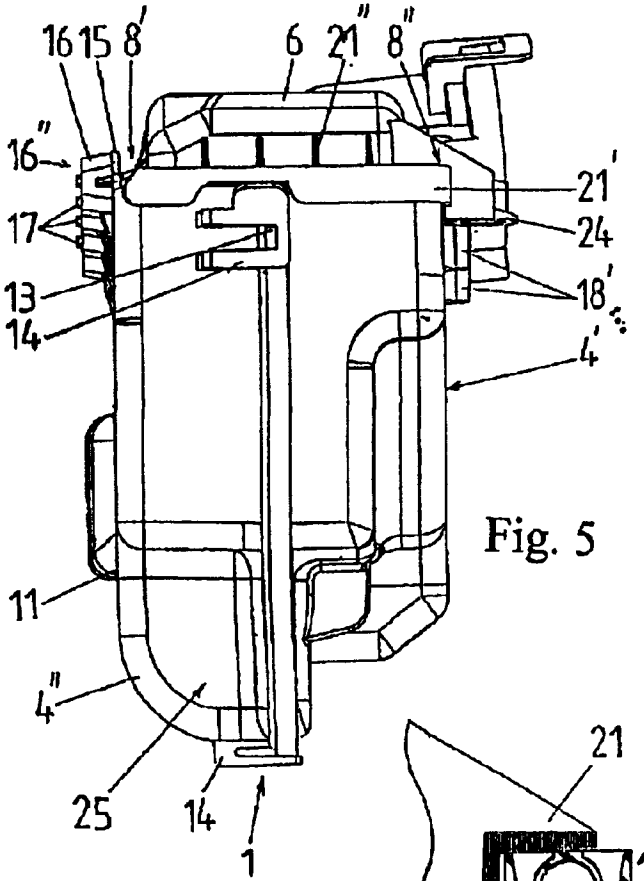
Figure 7:
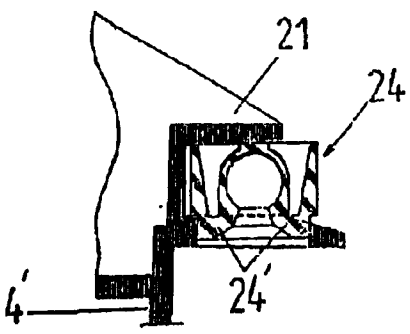

With a view to increasing further the rigidity of the cover 6/receptacle 4 assembly by additional mutual lateral locking, the portion of wall 21 in the form of a lateral peripheral band is extended, at least at the edges of the cover 6 having no connecting lugs 17, by a supplementary portion of wall 21' forming a skirt, partially overlapping, preferably with surface contact during assembly of cover 6/receptacle 4, the external faces of the walls of the half-casings 4', 4" at their edge 9, 9' defining the peripheral edge of the opening 7 of the receptacle 6, said supplementary lateral portion of wall 21' being moreover connected to the body of the cover 6 by ribs 21" (FIGS. 1, 2 and 5).

In accordance with another characteristic of the invention, illustrated partially in each of the FIGS. 1, 2, 3 and 6 of the accompanying drawings, the cover 6 and the two half-casings 4', 4" have on the internal constituent faces of their walls stiffening and reinforcing ribs 23, 23' formed in one piece with these walls, consisting of a first set of flat fins 23 extending in a parallel network over said faces and a second set of flat fins 23' extending substantially perpendicularly to the fins 23 of said first network.

The provision of reinforcing and stiffening ribs 23 and 23' on the internal faces of the walls of the receptacle 4 and the cover 6 in crossing and intersecting networks of ribs, allows great structural rigidity to be achieved for the two constituent parts 4 and 6 of the case 3, while at the same time making it possible to achieve external faces thereon that are substantially smooth and substantially without such ribs.

Installation and fitting of the air filter unit 1 according to the invention on the engine block can be achieved in different known ways.

Advantageously, however, the cover 6 can be provided with female fixing sites 24 for fitting of said air filter unit on swivel joint anchoring sites, said female fixing sites 24 being equipped with bearings 24' made of an elastic and resilient material, with vibration damping properties.

These sites 24 will preferably be arranged on the side of the cover 6 corresponding to the longitudinal part 8" of the edge 8.

Given the embodiment of the receptacle 4 in two complementary half-casings 4' and 4", permitting great freedom of shape, these two half-casings may have, on the portions of wall forming the bottom of the receptacle 4, a conformation suited to the configuration and geometry of the physical environment in this area after installation of said air filter unit 1.

These two half-casings 4' and 4" may in particular form, at the bottom of the receptacle 4, depressions, cavities or cups 25 that can fulfil, for example, the functions of condensate collection, dust recovery (dust extraction) or similar.

These arrangements are in particular easy to achieve when the cover 6 and the two half-casings 4, 4' are obtained by injection moulding of thermoplastic material(s).

The subject of the present invention is also an air filter suitable for fitting in a unit such as that described above, in the form of a right-angled parallelepiped and provided with a packing 22 at the ridges delimiting one of the faces of said parallelepiped and a pre-filter 2' on its opposite face.

Of course, the invention is not restricted to the embodiment described and illustrated in the accompanying drawings. Modifications are still possible, notably from the point of view of the composition of the various elements or by substitution of technical equivalents, without however departing from the scope of protection of the invention.

What is claimed is:

1. Air filter unit for a vehicle with an internal-combustion engine, comprising an air filter and a hollow case containing and holding the air filter in position, wherein said case (3) comprises, on one hand, a lower part (4) forming an open receptacle for said filter (2) and made up of at least two elementary parts (4', 4") assembled at complementary formations of their edges (5,5') put in contact and, on the other hand, an upper part (6) forming a cover and closing an upper opening (7) of the lower part (4), said upper part (6) and lower part (4) being assembled, with insertion of a seal or packing (22), at a lower peripheral edge (8) of said upper part (6) and at a peripheral edge (9, 9') of the opening (7) of the lower part (4), the lower part (4) being composed of two half-casings (4' and 4") cooperating to form said lower part (4) and assembled by mutual peripheral nesting, in a joint plane, of formations with substantially complementary profiles of their respective edges (5,5') in contact.

2. Unit according to claim 1, further comprising a cross bracing piece (10) rigidly connecting said two half-casings (4' and 4").

3. Unit according to claim 1, wherein the opening (7) of the lower pert (4) and an upper portion (4'") of the lower part (4) adjoining said opening (7) and receiving the filter (2), have a section corresponding substantially to that of said filter (2).

4. Unit according to claim 2, wherein the filter (2), and an upper portion (4'") of the lower receptacle (4) receiving said fiber (2), have a structure in substantially the general form of a right-angled parallelepiped and the cross bracing piece (10) has the form of an H, making a double connection between the two half-casings (4' and 4"), one of the half-casings incorporating an external air inlet sleeve (11) opening below the filter (2) and the upper part (6) forming a cover incorporating, in one piece, a filtered air outlet sleeve (11') opening above said filter (2).

5. Unit according to claim 2, wherein one (4') of the half-casings (4', 4") comprises a U-section edge formation (5) forming a peripheral groove (5"), and the other half-casing (4") comprises a flange-shaped edge formation (5') forming a peripheral rib (5'"), this peripheral groove (5") and this peripheral rib (5'") being formed on external sides of walls of the corresponding half-casings (4', 4").

6. Unit according to claim 5, wherein the peripheral groove (5") and the peripheral rib (5'") have complementary truncated forms in cross section.

7. Unit according to claim 2, wherein assembly of the two half-casings (4' and 4") is locked by mutual elastic interlocking of the complementary means of several pairs of cooperating means (13, 14) each formed on one of said half-casings (4', 4") at their edges (5 and 5') in contact, one means (13) having the form of a projecting notch formed on an external face of the formation (5") of the edge (5) of the half-casing (4') and the other means (14) having the form of a U-shaped elastic lip, formed on the an external face of the half-casing (4"), extending over the edge (5') thereof to engage with said notch (13) when the two half-casings (4' and 4") are assembled.

8. Unit according to claim 1, wherein assembly of the two half-casings (4' and 4") is made non-detachable by establishing a rigid continuous connection between said two half-casings (4' and 4") for example by laminating or vibration welding, at formations of the edges (5 and 5') in contact.

9. Unit according to claim 5, wherein a joint is housed in the peripheral groove (5"), for example in the form of a joint set in silicone, and, if need be, compressed by nesting of the peripheral rib (5'") in said peripheral groove (5") in order to connect the two half-casings (4' and 4").

10. Unit according to claim 2, wherein means of assembling the cover (6) with the receptacle (4) consist of a portion of wall (15) extending the longitudinal wall of one of the two half-casings (4', 4") beyond its upper edge (9, 9') and provided with at least two, preferably four, passages (16) forming eyelets for the reception of two, preferably four, connecting logs (17) extending or formed on a longitudinal part (8') of the lower peripheral edge (8) of the cover (6), a part of longitudinal edge (8") opposite the cover (6) and the upper edge (9', 9) of the longitudinal wall of the other half-casing (4", 4') being equipped with two, preferably two pairs of, sites (18. 18") cooperating for fitting of a means of connection (19) to lock the cover (6)/receptacle (4) assembly.

11. Unit according to claim 10, wherein the eyelet-shaped passages (16) consist of portions of sleeves of substantially rectangular section flaring towards their respective inlet openings (16'), and the lugs (17) have a substantially rectangular cross section tapering towards their free ends.

12. Unit according to claim 10, wherein lower faces of the connecting lugs (17) and the lower internal walls (16'") of the eyelet (16) in the form of sleeves are in contact at contact areas formed by portions of aligned rows or strips together providing a pivot axis (AX), after introduction of said lugs (17) into said eyelets (16) for folding down the cover (6) onto the receptacle (4) until a forced peripheral contact is obtained therebetween with squeezing or compression of the seal (22), the assembly being maintained simultaneously by connection means (19) fitted in suitable cooperating sites (18 and 18') and by support of upper surfaces of the connecting lugs (17) against upper internal wails (16"") of said eyelets (16) in the form of sleeves.

13. Unit according to claim 10, wherein the eyelets (16) in the form of sleeves have inlet openings (16') and outlet openings (16") flaring in opposite directions, so as to form crossing passages tilted in relation to the plane receiving the cover (6) when assembled with the receptacle (4).

14. Unit according to claim 10, wherein the two half-casings (4', 4") comprise at their edges (9, 9") which together define the peripheral edge of the opening (7) of the receptacle (4), a circumferential formation (20) forming an internal rim and the cover (6) comprises a portion of wall (21) in the form of a lateral peripheral band, extending radially towards the outside from its lower peripheral edge (8) and overlapping the above-mentioned internal rim (20) when cover (6)/receptacle (4) are assembled, the filter (2) having at its upper peripheral edge the packing (22), squeezed between the internal rim (20) and the lateral peripheral band (21) during assembly of cover (6)/receptacle (4).

15. Unit according to claim 14, wherein the portion of wall (21) in the form of a lateral peripheral band is extended, at least at the edges of the cover (6) having no connecting lugs (17), by a supplementary portion of wall (21') forming a skirt, partially overlapping, preferably with surface contact during assembly of cover (6)/receptacle (4), the external feces of the walls of the half-casings (4', 4") at their edge (9, 9') defining the peripheral edge of the opening (7) of the receptacle (6), said supplementary lateral portion of wall (21') being moreover connected to the body of the cover (6) by ribs (21").

16. Unit according to claim 1, wherein the filter (2) is provided on its lower face, directed towards the bottom of the receptacle (4), with a pre-filter (2'), and said receptacle (4) is equipped with an internal peripheral projection, for example in the form of a flange, extending immediately below the pre-filter (2') when said filter (2) is mounted in the case (3).

17. Unit according to claim 2, wherein the cover (6) and the two half-casings (4', 4") have on internal constituent faces of their walls stiffening and reinforcing ribs (23, 23') formed in one piece with these walls, consisting of a first set of flat fins (23) extending in a parallel network over said faces and a second set of flat fins (23') extending substantially perpendicularly to the fins (23) of said first network.

18. Unit according to claim 2, wherein the covet (6) is provided with female fixing sites (24) for fitting of said air filter unit (1) on swivel joint anchoring sites, said female fixing sites (24) being equipped with bearings (24') made of an elastic and resilient material, with vibration damping properties.

19. Unit according to claim 2, wherein the two half-casings (4', 4") have at the portions of wall forming a bottom of the receptacle (4) a conformation suited to the configuration and geometry of the physical environment in this area after installation of said air filter unit (1).

20. Unit according to claim 2, wherein the cover (6) and the two half-casings (4, 4") are obtained by injection moulding of thermoplastic material(s).

21. Unit according to claim 1, wherein it has the form of a right-angled parallelepiped, and it is provided with a packing (22) at the ridges delimiting one of the faces of said parallelepiped and a pre-filter (2') on its opposite face.

* * * * *